US011828484B2

(12) United States Patent
Phillips

(10) Patent No.: US 11,828,484 B2
(45) Date of Patent: Nov. 28, 2023

(54) CONDENSATE RECEPTOR WITH HEAT SHIELD FOR VERTICAL MOUNTED V-COIL HEAT EXCHANGER

(71) Applicant: CARRIER CORPORATION, Palm Beach Gardens, FL (US)

(72) Inventor: Charles Christensen Phillips, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/253,302

(22) PCT Filed: Jul. 17, 2020

(86) PCT No.: PCT/US2020/042437
§ 371 (c)(1),
(2) Date: Dec. 17, 2020

(87) PCT Pub. No.: WO2021/021463
PCT Pub. Date: Feb. 4, 2021

(65) Prior Publication Data

US 2022/0186977 A1 Jun. 16, 2022

Related U.S. Application Data

(60) Provisional application No. 62/879,871, filed on Jul. 29, 2019.

(51) Int. Cl.
*F24F 13/22* (2006.01)
*F24F 13/30* (2006.01)

(52) U.S. Cl.
CPC ..... *F24F 13/222* (2013.01); *F24F 13/30* (2013.01)

(58) Field of Classification Search
CPC ..... F24F 13/22; F24F 13/30; F24F 13/222; F24F 13/224; F28F 17/005;
(Continued)

(56) References Cited

U.S. PATENT DOCUMENTS 3,750,418 A 8/1973 Maudlin
4,907,420 A * 3/1990 Mahanay ..... F25D 21/14 62/291
(Continued)

FOREIGN PATENT DOCUMENTS

CN 1227488 C 11/2005
CN 204254850 U 4/2015
(Continued)

OTHER PUBLICATIONS

International Search Report; International Application No. PCT/US2020/042437; International Filing Date: Jul. 17, 2020; dated Oct. 2, 2020; 5 pages.
(Continued)

*Primary Examiner* — Harry E Arant
(74) *Attorney, Agent, or Firm* — CANTOR COLBURN LLP

(57) ABSTRACT

Disclosed is a system for receiving condensate from a v-coil heat exchanger (v-coil), having: a receptor that has: a first channel having a first length defined between first opposing ends, the first channel configured to receive the v-coil, the first channel having a first bottom surface; a second channel disposed at an angle to the first channel and connecting with the first channel at a junction so that fluid flows downstream from the first channel into the second channel, the second channel having a second bottom surface that extends below the first bottom surface; and a heat shield connected to the first channel and extending below the first channel.

14 Claims, 9 Drawing Sheets

(58) Field of Classification Search
CPC . F28F 2009/004; F28F 9/001; F28D 1/05366; F28D 2001/0266; F28D 2021/0068
See application file for complete search history.

(56) References Cited

U.S. PATENT DOCUMENTS

| | | | | |
|---|---|---|---|---|
| 5,071,027 | A | 12/1991 | Sullivan | |
| 5,195,332 | A | 3/1993 | Sullivan | |
| 5,263,892 | A | 11/1993 | Vandervaart | |
| 6,497,255 | B1 | 12/2002 | Adams et al. | |
| 6,729,152 | B2 * | 5/2004 | Gully | B60H 1/00514 62/276 |
| 6,901,766 | B1 | 6/2005 | Jin et al. | |
| 7,003,972 | B2 | 2/2006 | Eom et al. | |
| 7,430,877 | B2 | 10/2008 | Davenport et al. | |
| 7,669,641 | B2 | 3/2010 | Rembold et al. | |
| 8,220,282 | B2 | 7/2012 | Hast et al. | |
| 8,869,548 | B2 | 10/2014 | Piccione | |
| 9,279,620 | B2 | 3/2016 | Edens et al. | |
| 9,759,446 | B2 | 9/2017 | Stewart et al. | |
| 10,077,917 | B2 | 9/2018 | Amick et al. | |
| 10,240,853 | B2 | 3/2019 | Mercer et al. | |
| 2011/0016903 | A1 | 1/2011 | Ballet et al. | |
| 2013/0168067 | A1 * | 7/2013 | Edens | F24F 1/032 165/163 |
| 2015/0153095 | A1 | 6/2015 | Mercer et al. | |

FOREIGN PATENT DOCUMENTS

| | | | |
|---|---|---|---|
| CN | 206861838 | U | 1/2018 |
| CN | 105928067 | B | 12/2018 |
| CN | 208254307 | U | 12/2018 |
| CN | 105972695 | B | 3/2019 |
| CN | 208750990 | U | 4/2019 |

OTHER PUBLICATIONS

Written Opinion; International Application No. PCT/US2020/042437; International Filing Date: Jul. 17, 2020; dated Oct. 2, 2020; 7 pages.

* cited by examiner

CONDENSATE RECEPTOR WITH HEAT SHIELD FOR VERTICAL MOUNTED V-COIL HEAT EXCHANGER

CROSS REFERENCE TO RELATED APPLICATIONS

This application is a National Stage application of PCT/US2020/042437 filed Jul. 17, 2020, which claims the benefit of U.S. Provisional Application No. 62/879,871, filed Jul. 29, 2019, both of which are incorporated by reference in their entirety herein.

BACKGROUND

The disclosed embodiments relate to cooling systems and more specifically to a condensate receptor with a heat shield for an air conditioning evaporator coil that is a v-coil heat exchanger (v-coil).

An evaporator coil is used with air conditioner (AC) systems. The evaporator coil becomes cold when the unit operates. It is mounted in (or connected in line with) the ductwork of, for example, a home. When the AC system is on, air flows through the coil and the cold air is distributed throughout the home. The AC systems may use a micro-channel heat exchanger (MCHX) as an evaporator, where the MCHX may be configured as a v-coil heat exchanger (v-coil), which may be mounted vertically in a housing. It is desirable to provide a condensate receptor that is effective in capturing condensate from an MCHX for removing the condensate from the housing.

SUMMARY

Disclosed is a system for receiving condensate from a v-coil heat exchanger (v-coil). The system includes a receptor; the receptor including: a first channel having a first length defined between first opposing ends, the first channel configured to receive the v-coil, the first channel having a first bottom surface; a second channel disposed at an angle to the first channel and connecting with the first channel at a junction so that fluid flows downstream from the first channel into the second channel, the second channel having a second bottom surface that extends below the first bottom surface; and a heat shield connected to the first channel and extending below the first channel.

In addition to one or more of the above disclosed features, or as an alternate, a bottom surface of the heat shield is level with the second bottom surface of the second channel.

In addition to one or more of the above disclosed features, or as an alternate, the heat shield has side walls that converge at the bottom surface of the heat shield so that an air gap is formed between the first channel and the heat shield.

In addition to one or more of the above disclosed features, or as an alternate, the bottom surface of the heat shield forms a rounded base.

In addition to one or more of the above disclosed features, or as an alternate, the heat shield connects with the first channel at or below a bottom portion of the first channel.

In addition to one or more of the above disclosed features, or as an alternate, the heat shield is fastened to the first channel at or below the bottom portion of the first channel.

In addition to one or more of the above disclosed features, or as an alternate, the heat shield is fastened against an upstream end of the first channel.

In addition to one or more of the above disclosed features, or as an alternate, the heat shield is fastened to the first channel with screws.

In addition to one or more of the above disclosed features, or as an alternate, the system includes a v-coil heat exchanger fixedly supported to the receptor.

In addition to one or more of the above disclosed features, or as an alternate, the heat shield connects with the first channel at top edges of opposing side walls of the first channel.

In addition to one or more of the above disclosed features, or as an alternate, a bottom portion of each of the opposing side walls of the second channel is oriented at a mutually converging angle and the side walls of the heat shield are oriented at the same converging angle so that the bottom portion of the side walls of the first channel and the side walls of the heat shield are parallel.

In addition to one or more of the above disclosed features, or as an alternate, a top portion of each of the opposing side walls of the first channel are mutually parallel and the heat shield and first channel are configured so that air gaps are provided between the top portion of each of the opposing side walls of the first channel and the heat shield.

In addition to one or more of the above disclosed features, or as an alternate, the side walls of the heat shield are offset from the bottom portion of each of the opposing side walls of the first channel, thereby providing air gaps between the heat shield and the bottom portion of each of the opposing side walls of the first channel.

In addition to one or more of the above disclosed features, or as an alternate, the heat shield is a V shape with rounded top edges that extend toward one another to engage top edges of the opposing side walls of the first channel.

In addition to one or more of the above disclosed features, or as an alternate, contact between the heat shield and the first channel is only along the top edges of the opposing side walls of the first channel, thereby providing continuous air gaps between the heat shield and the first channel around the opposing side walls of the first channel and the bottom surface of the first channel.

In addition to one or more of the above disclosed features, or as an alternate, the heat shield connects with grooves formed in the top edges of the opposing side walls of the first channel.

In addition to one or more of the above disclosed features, or as an alternate, a span of the grooves in the top edges of the opposing side walls of the first channel is from an upstream end of the first channel to a downstream and of the first channel and the heat shield connects with the grooves along the span of the grooves.

In addition to one or more of the above disclosed features, or as an alternate, the heat shield is formed of a resilient material that biases the rounded top edges of the heat shield into the grooves of the first channel.

In addition to one or more of the above disclosed features, or as an alternate, the heat shield is plastic or metal.

In addition to one or more of the above disclosed features, or as an alternate, the system includes a v-coil heat exchanger fixedly supported to the receptor.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
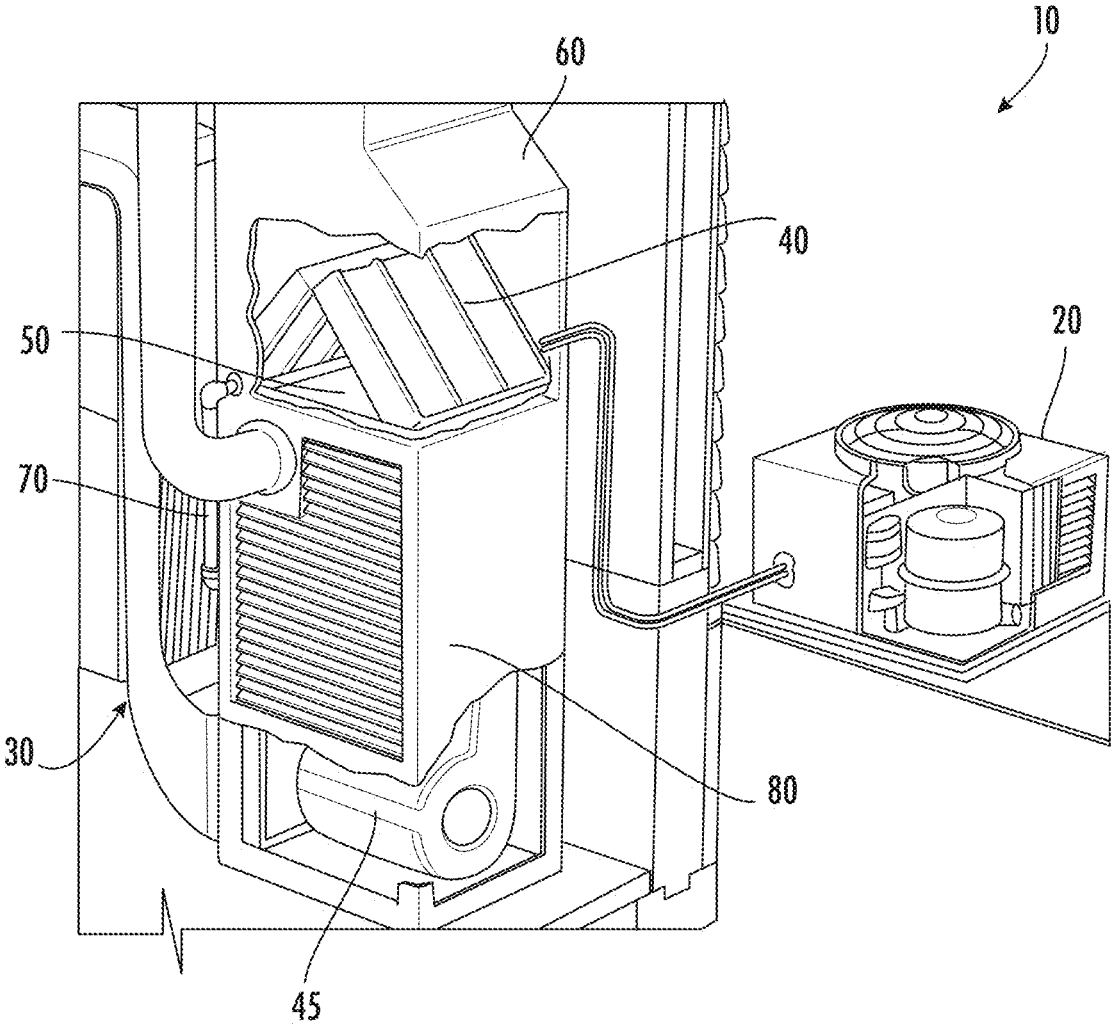
FIG. 1 illustrates an air conditioning system that may include or be modified to include one or more features of the disclosed embodiments.

FIG. 1 illustrates an air conditioning system (AC system) 10. The AC system 10 includes a condenser assembly 20 and an evaporator assembly 30. The evaporator assembly 30, may also be referred to as an air handler, includes evaporator coils (coils) 40, a blower 45, a plenum 60 and evaporator drain lines 70. The coils 40 form a heat exchanger and are configured as A-coils. The coils 40 are disposed over a drip pan 50, which may also be referred to as a condensate receptor. The evaporator assembly 30 also includes a housing 80. With the configuration of FIG. 1, effective draining of condensate from the coils 40 may be a challenge.

Figure 2B:
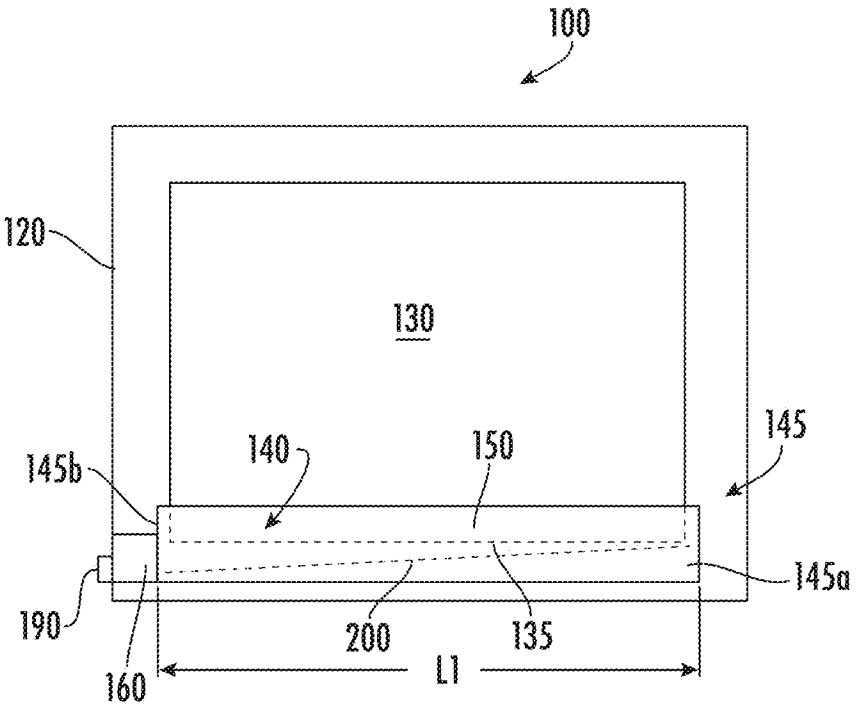
FIGS. 2*a*-2*c* illustrate a coil assembly including a v-coil and receptor within a housing according to an embodiment.
Figure 2A:
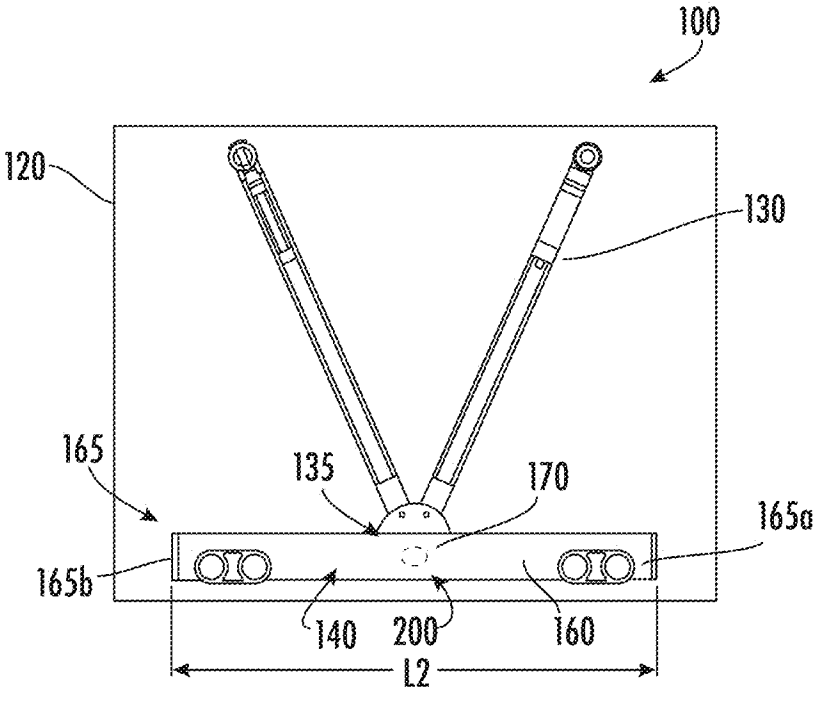
Figure 2C:
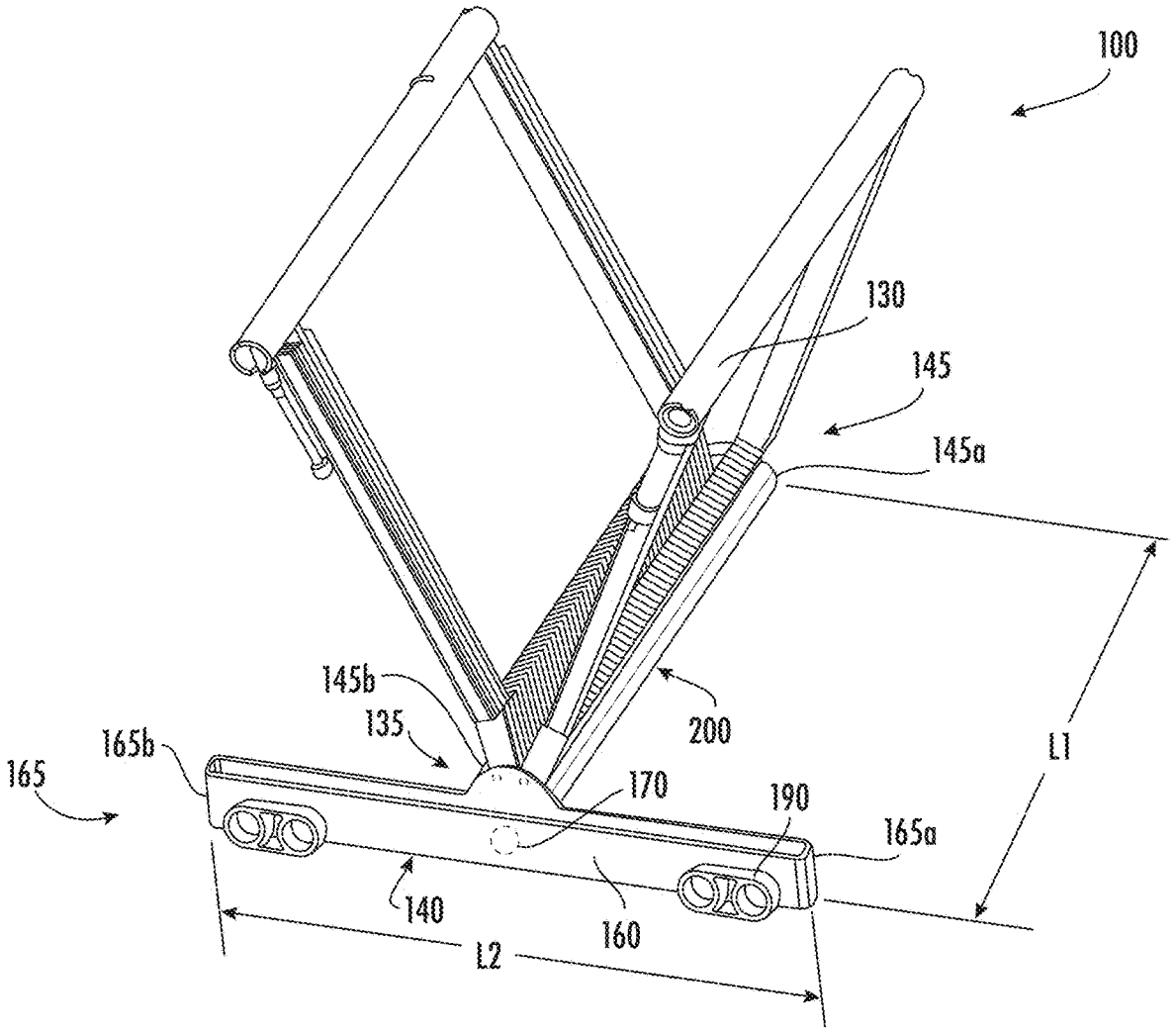

Turning to FIGS. 2*a*-2*c* disclosed is an assembly 100 (alternatively referred to herein as a system) for the AC system 10. The assembly 100 includes an evaporator housing (housing) 120 (not illustrated in FIG. 2), a microchannel heat exchanger configured as a v-coil 130 heat exchanger (v-coil) 130, which is vertically mounted within the housing 120. The v-coil 130 may be implemented utilizing a round tube plate fin constructions, instead of a microchannel heat exchanger. A condensate receptor (receptor) 140 is mounted within the housing 120, below the v-coil 130, for receiving condensate from the v-coil 130.

The receptor 140 includes a first channel 150 having a first length L1 defined between first opposing ends 145, including an upstream end 145*a* and a downstream end 145*b*. The first channel 150 is configured to receive the v-coil 130. A second channel 160 of the receptor 140 has a second length L2 defined second opposing ends 165, including a proximate end 165*a* and a distal end 165*b*. The second channel 160 is perpendicular to the first channel 150. The second channel 160 may include a first orifice 170 illustrated schematically intermediate the second opposing ends 165 for receiving condensate from the first channel 150.

Figure 3A:
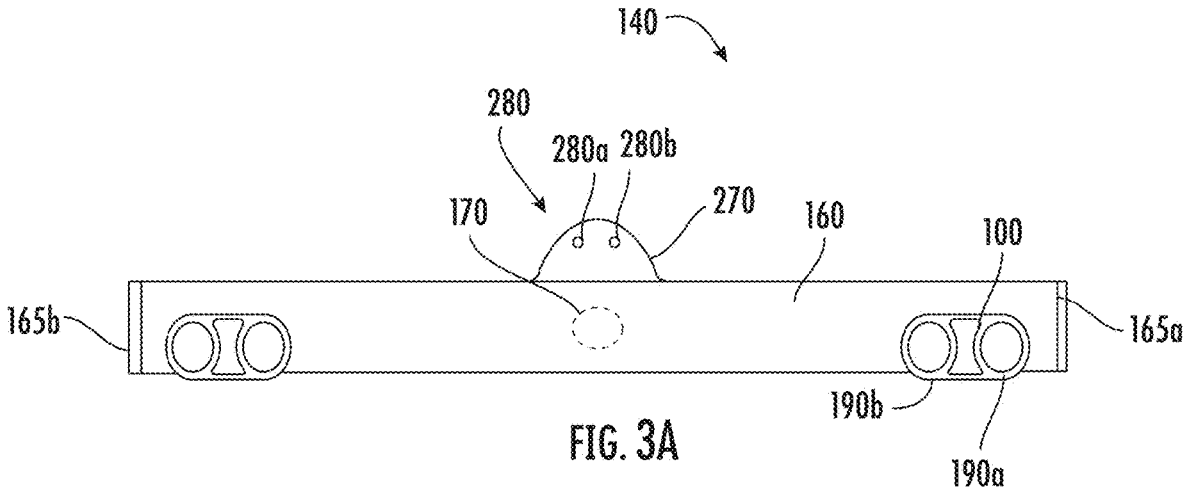
FIGS. 3*a*-3*c* illustrate a receptor according to an embodiment.
Figure 3B:
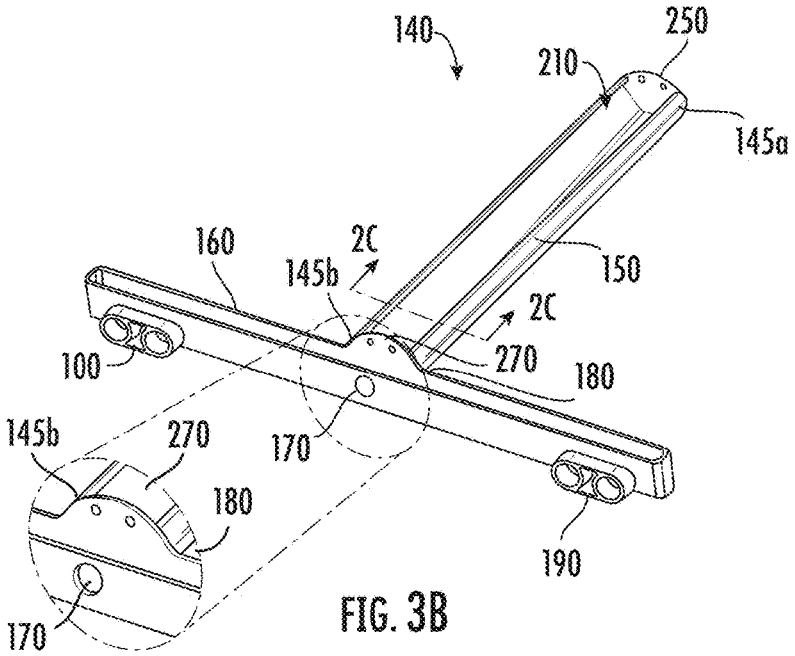
Figure 3C:
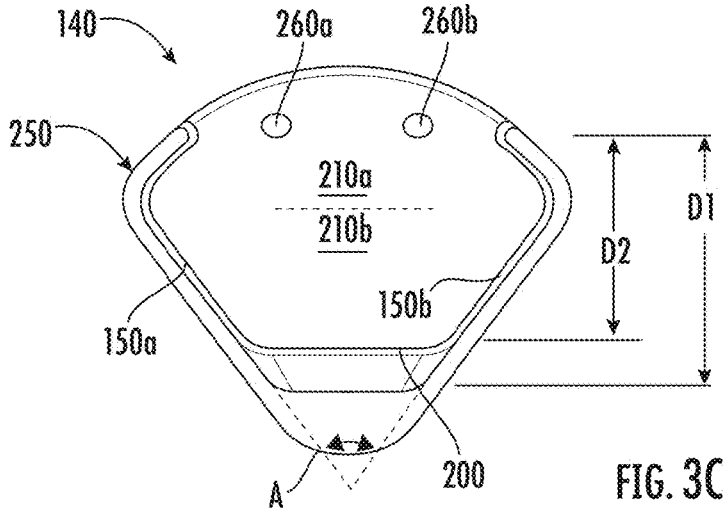

Turning to FIGS. 3*a*-3*c*, the first orifice 170 is fluidly connected to one end of the first opposing ends 145 and specifically the downstream end 145*b*, at a junction 180 which substantially defines a T-shape. For example the downstream end 145*b* opens into the second channel 160 to allow condensate to flow substantially unobstructed from the first channel 150 to the second channel 160. The second channel 160 includes a fluid drain port (port) 190 at one or both of the second opposing ends 165. The port 190 may comprise a pair of ports 190*a*, 190*b* that are together disposed at the one or both of the second opposing ends 165. Each port 190 has a circular profile for condensate drainage therethrough. As can be appreciated providing drain ports at both of the second opposing ends 165 increases an ability to drain condensate from the receptor 140. In addition, each port 190 is configured to protrude from the housing 120 (FIG. 2*b*) to enable removing of the condensate from the assembly 100.

In an embodiment the first channel 150 may have a bottom surface 200 (FIG. 2*b*) that is sloped between first opposing ends 145. From this configuration a first depth D1 of the first channel 150, located at the junction 180, is deeper than a second depth D2 of the first channel 150 located at the other end of the first channel 150.

In an embodiment the first channel 150 includes a cross section 210 referenced in FIG. 3*b* and illustrated, for example, in FIG. 3*c*. The cross section 210 includes a top portion 210*a* that is arcuate, for example, semicircular, and a bottom portion 210*b* that is frustoconical. That is, in the bottom portion 210*b*, side surfaces 150*a*, 150*b* of the first channel 150 converge toward the bottom surface 200 of the first channel 150. A converging angle A between the side surfaces 150*a*, 150*b* may be between approximately 50° and approximately 90°, which may be optimized to limit impact on the airflow. Other angle configurations, below 50° and above 90°, are within the scope of the disclosed embodiments so as to optimize performance. In an embodiment a shape of the top portion 210*a* of the cross section 210 is constant between the first opposing ends 145. On the other hand, the second channel 160 has a second internal cross section that is rectangular.

When installing the v-coil 130, a bottom 135, such as a bottom apex, of the v-coil 130 may be positioned close to or against at least part of the bottom surface 200 (FIGS. 2*a*-2*b*). This steadies the v-coil 130 during installation and, in addition, the shape of the converging orientation of the side surfaces 150*a*, 150*b* provide for vertical (upright) alignment of the v-coil 130 during installation.

In an embodiment the upstream end 145*a* of the first channel 150 includes an upstream end wall 250 (FIG. 3*c*) having a shape that conforms to the cross section 210. The upstream end wall 250 includes an upstream mounting hole 260, which may be a set of holes 260*a*, 260*b*, configured to mount the receptor 140 to a housing 120, the v-coil 130, or other support structure. The downstream end 145*b* includes a downstream end wall 270 that is a partial end wall having a shape that conforms with at least the top portion 210*a* of the cross section 210. Below the downstream end wall 270, the first orifice 170 provides for flow into the second channel 160, as indicated, to allow condensate to flow to the second channel 160. The downstream end wall 270 may include a downstream mounting hole 280 (FIG. 3*a*), which may be another set of holes 280*a*, 280*b*, configured to mount the receptor 140 to the housing 120.

Figure 4:
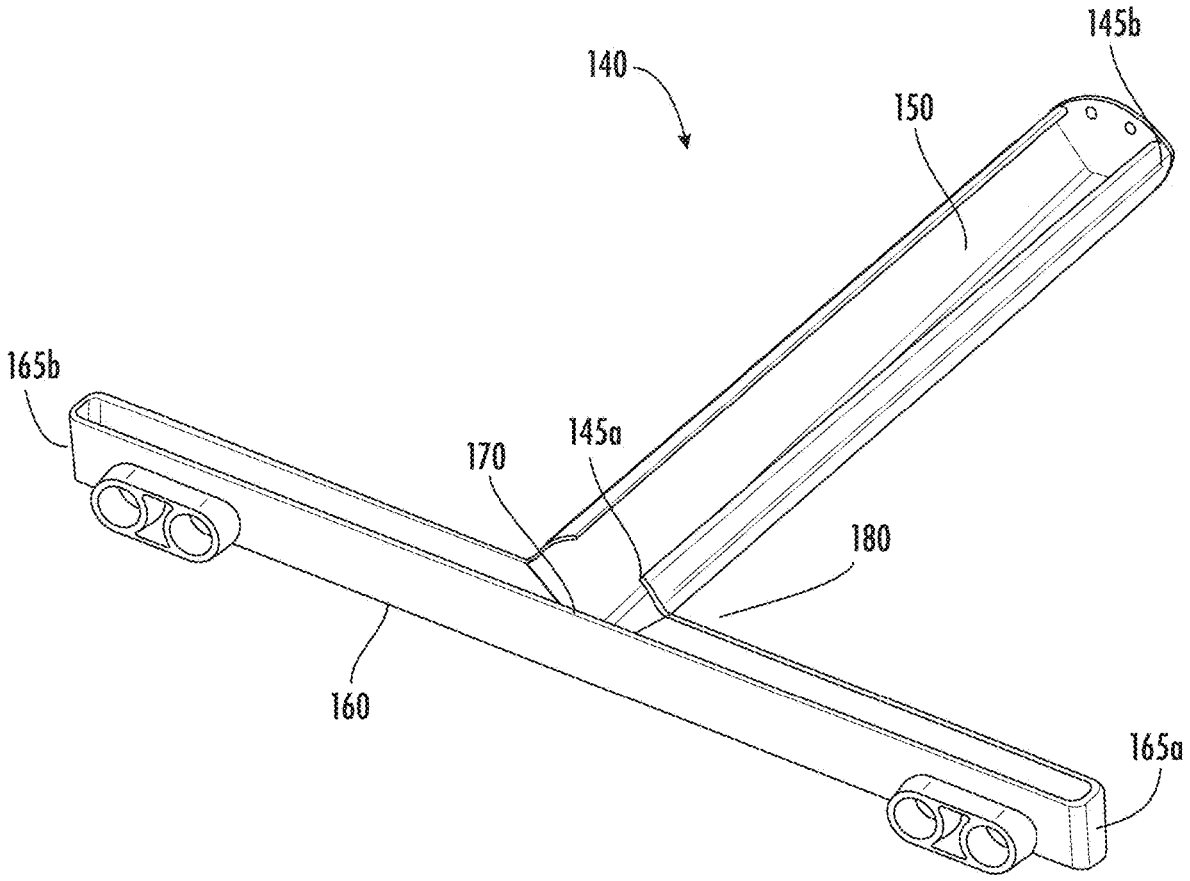
FIG. 4 illustrates a receptor according to an embodiment.

Turning to FIG. 4, an embodiment of the receptor 140 has each of the features of the embodiment illustrated in FIGS. 3*a*-3*c* except for the downstream end wall 270 in the first channel 150. Thus, the first channel 150 and second channel 160 are opened at a top thereof between the first opposing ends 145, the second opposing ends 165 and at the junction 180. In comparison, in the embodiment in FIGS. 3*a*-3*c* the first channel 150 and second channel 160 are opened at the top thereof between the first opposing ends 145, the second opposing ends 165, but the downstream end wall 270 provides an effective cover at the junction 180.

Figure 5A:
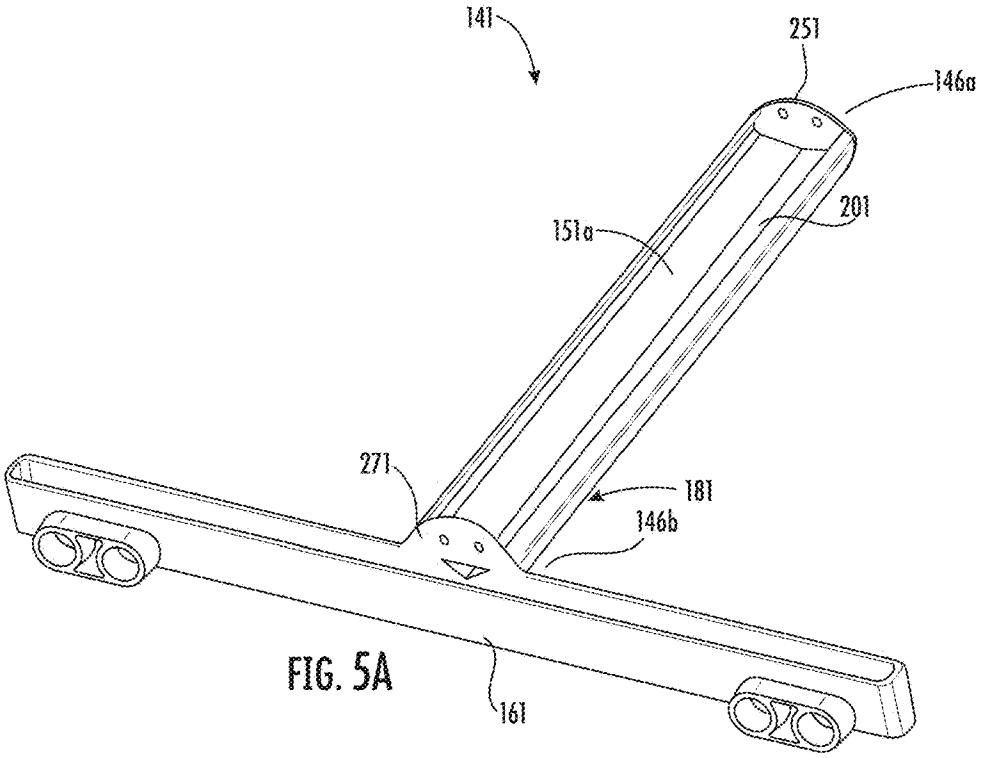
FIGS. 5*a*-5*b* illustrate another receptor according to an embodiment.
Figure 5B:
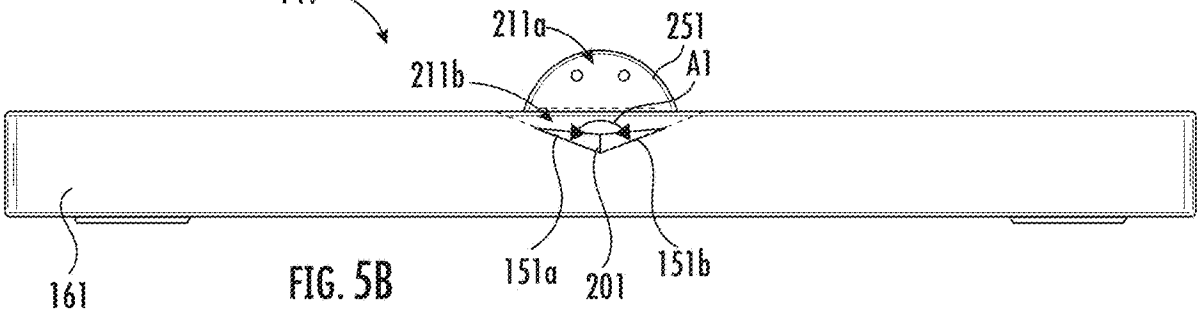

The v-coil 130 is to be utilized in an air conditioning appliance such as a fan coil or furnace coil. In the furnace coil application, heat from the cells of the furnace may radiate onto the receptor. While the maximum temperature of the air may be well below limits of the receptor, radiation may cause the material to heat beyond the limits of the material properties. In view of such concerns, turning to FIGS. 5*a*-5*b*, an embodiment of the receptor 141 is illustrated wherein differences between such embodiment and the receptor 140 in the embodiment illustrated in FIGS. 2A-4 are only those identified herein. Features in FIGS. 5*a*-5*b* having a same name as those in FIGS. 2A-4 shall be construed the same as those in FIGS. 2A-4 except as identified herein.

The first channel 151 in the receptor 141 extends between an upstream end 146*a* at an upstream end wall 251, and a downstream end 146*b* at a downstream end wall 271 at a junction 181 between the first channel 151 and a second channel 161. The first channel 151 includes a bottom surface 201 extending between the upstream end wall 251 and the downstream end wall 271. The first channel 151 at the upstream end wall 251 has a top portion 211*a* and a bottom portion 211*b*. In the bottom portion 211*b*, side surfaces 151*a*, 151*b* of the first channel 151 converge toward the bottom surface 201 of the first channel 151.

The first channel 151 in the receptor 141 is shallow compared with the first channel 150 in the receptor 140. At the upstream end wall 251 the side surfaces 151*a*, 151*b* and the bottom surface 201 are continuous without extending below an arcuate transition between the top portion 211*a* and the bottom portion 211*b*. At the downstream end wall 271, a converging angle A1 between the side surfaces 151*a*, 151*b* is about at least 120 degrees with the bottom surface 201 extending therebetween.

Figure 6A:
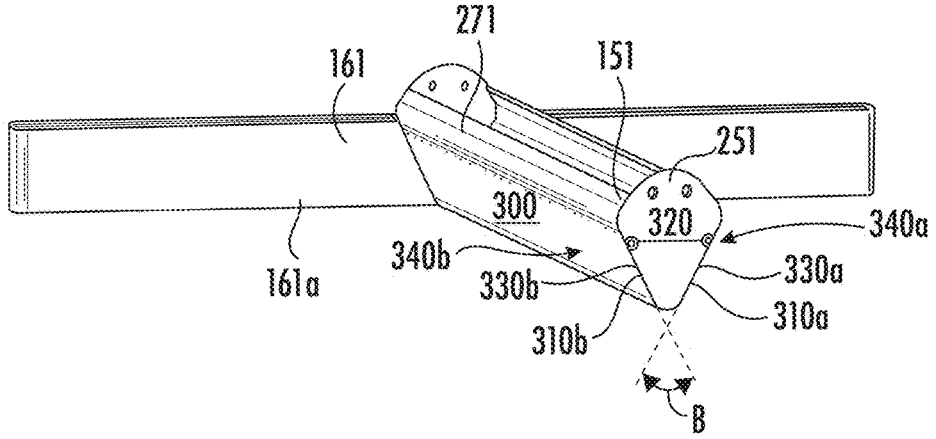
FIGS. 6*a*-6*c* illustrate the receptor of FIGS. 5*a*-5*b* with a heat shield according to an embodiment.
Figure 6B:
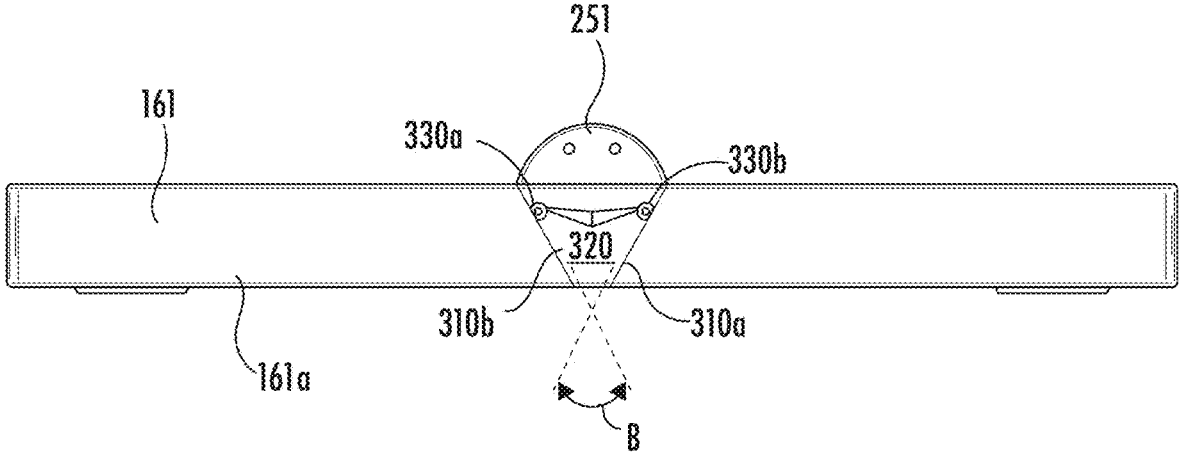
Figure 6C:
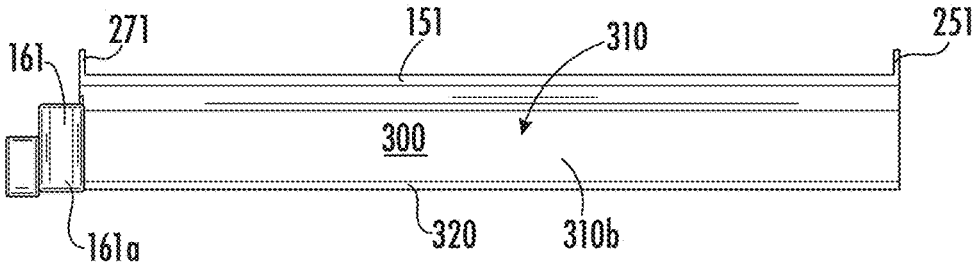

Turning to FIGS. 6A-6C a heat shield 300 is attached to the first channel 151 of the receptor 141. The heat shield 300 extends downwardly from the first channel 151 to a depth of a bottom surface 161*a* of the second channel 161. The heat shield 300 covers an exterior of the side surfaces 151*a*, 151*b* and the bottom surface 201 between the upstream end wall 251 and the downstream end wall 271. The heat shield 300 has a constant cross section along its length and includes side walls 310 including a first side wall 310*a* and second side wall 310*b*. The side walls 310 extend from a bottom apex 320 by a converging angle B that is the same as the converging angle A illustrated in FIG. 3C. This configuration creates an air gap around each of the side surfaces 151*a*, 151*b* and the bottom surface 201.

The heat shield 300 may be fastened to the first channel 151 utilizing a pair of screw terminals 330 located at the upstream end wall 251 that connect with opposing top edges 340*a*, 340*b* of the respective side walls 310.

Figure 7A:
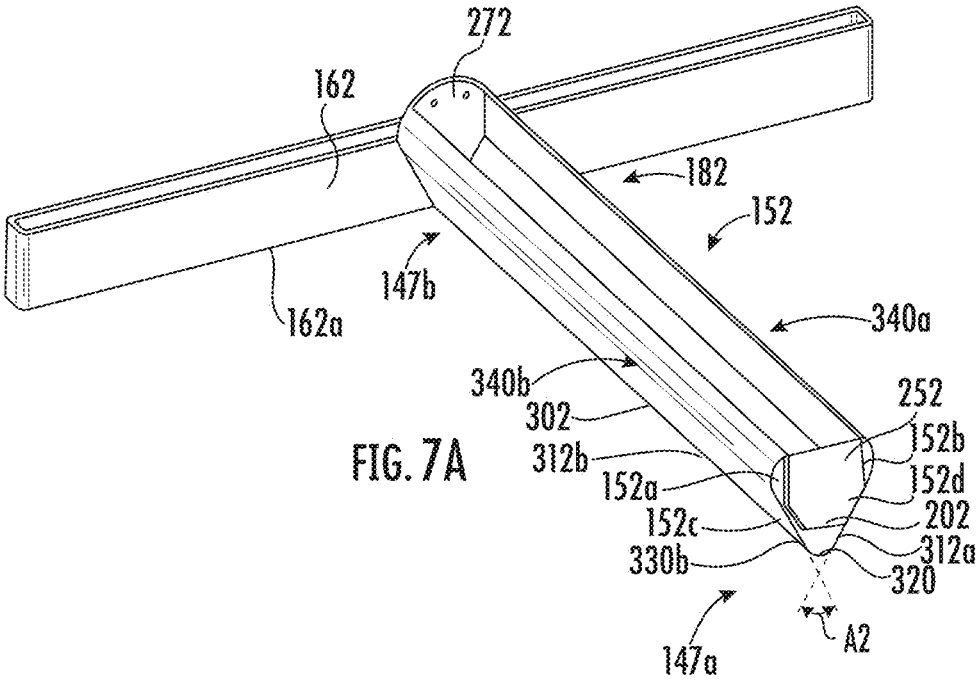
FIGS. 7*a*-7*d* illustrate a further receptor with a further heat shield according to an embodiment.
Figure 7B:
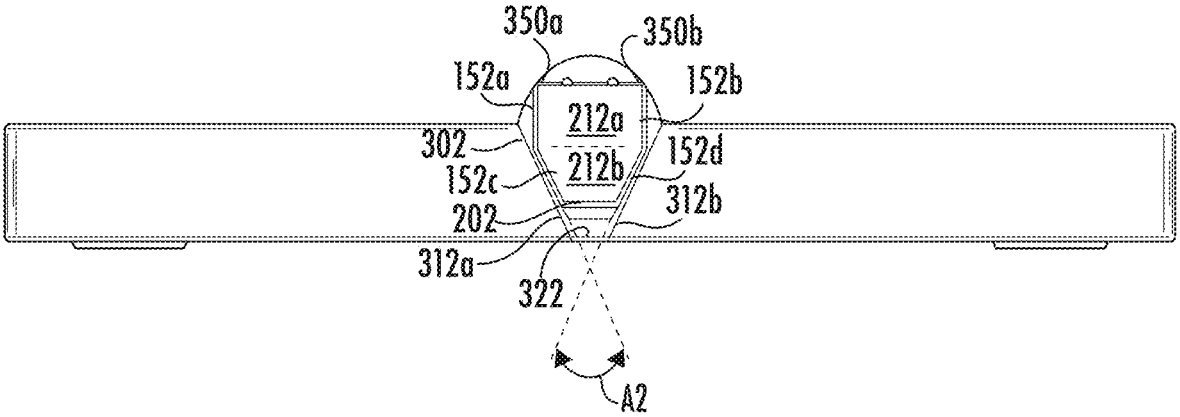
Figure 7C:
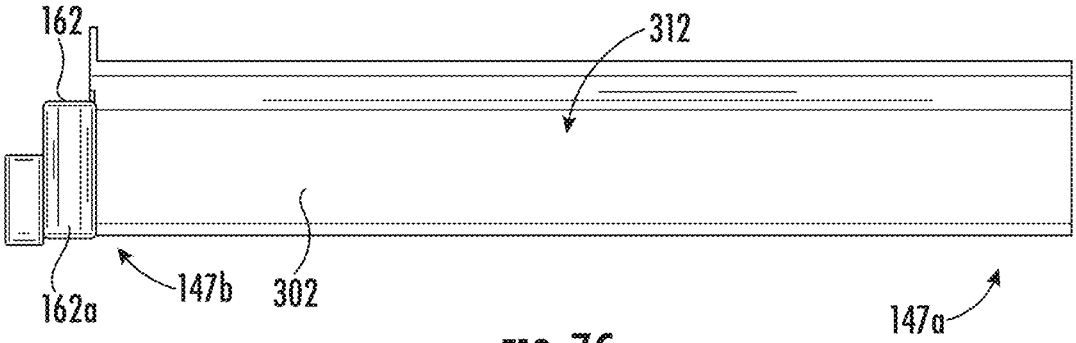

Turning to FIGS. 7*a*-7*c*, an embodiment of the receptor 142 is illustrated wherein differences between such embodiment and the receptor 140 in the embodiment illustrated in FIGS. 2A-4 are only those identified herein. Features in FIGS. 7*a*-7*c* having a same name as those in FIGS. 2A-4 shall be construed the same as those in FIGS. 2A-4 except as identified herein.

The first channel 152 in the receptor 142 extends between an upstream end 147*a* at an upstream end wall 252, and a downstream end 147*b* at a downstream end wall 272 at a junction 182 between the first channel 152 and a second channel 162. The first channel 152 includes a bottom surface 202 extending between the upstream end wall 252 and the downstream end wall 272.

At the upstream end wall 252, the first channel 152 has a top portion 212*a* with a rectangular shape having first side surfaces 152*a*, 152*b* that oppose each other. The bottom portion 211*b* of the first channel 152 is trapezoidal with second side surfaces 152*c*, 152*d* that oppose each other and converge toward the bottom surface 202 of the first channel 152. A converging angle A2 between the second side surfaces 152*c*, 152*d* is the same as the converging angle A disclosed above.

A heat shield 302 is attached to the first channel 152 of the receptor 142. The heat shield 302 surrounds the exterior or the first channel 152, from respective top edges 350*a*, 350*b* of the first side surfaces 152*a*, 152*b* to a depth of a bottom surface 162*a* of the second channel 162. The heat shield 302 covers an exterior of the first side surfaces 152*a*, 152*b*, the second side surfaces 152*c*, 152*d* and the bottom surface 202 between the upstream end wall 252 and the downstream end wall 272. The heat shield 302 has a constant cross section along its length and includes side walls 312 including a first side wall 312*a* and second side wall 312*b* extending from a bottom apex 322 by the converging angle A2. This configuration creates an air gap around each of the first side surfaces 152*a*, 152*b*, the second side surfaces 152*c*, 152*d* and the bottom surface 202. As the convergence angle A2 is the same for the heat shield 304 and the second side surfaces 152*c*, 152*d* of the first channel 152, these side surfaces are parallel with the side walls 312 of the heat shield 302. Thus, the air gap between the heat shield 302 and the first channel 151 is larger around the first side surfaces 152*a*, 152*b* and the bottom surface 202 then at the second side surfaces 152*c*, 152*d*.

Figure 7D:
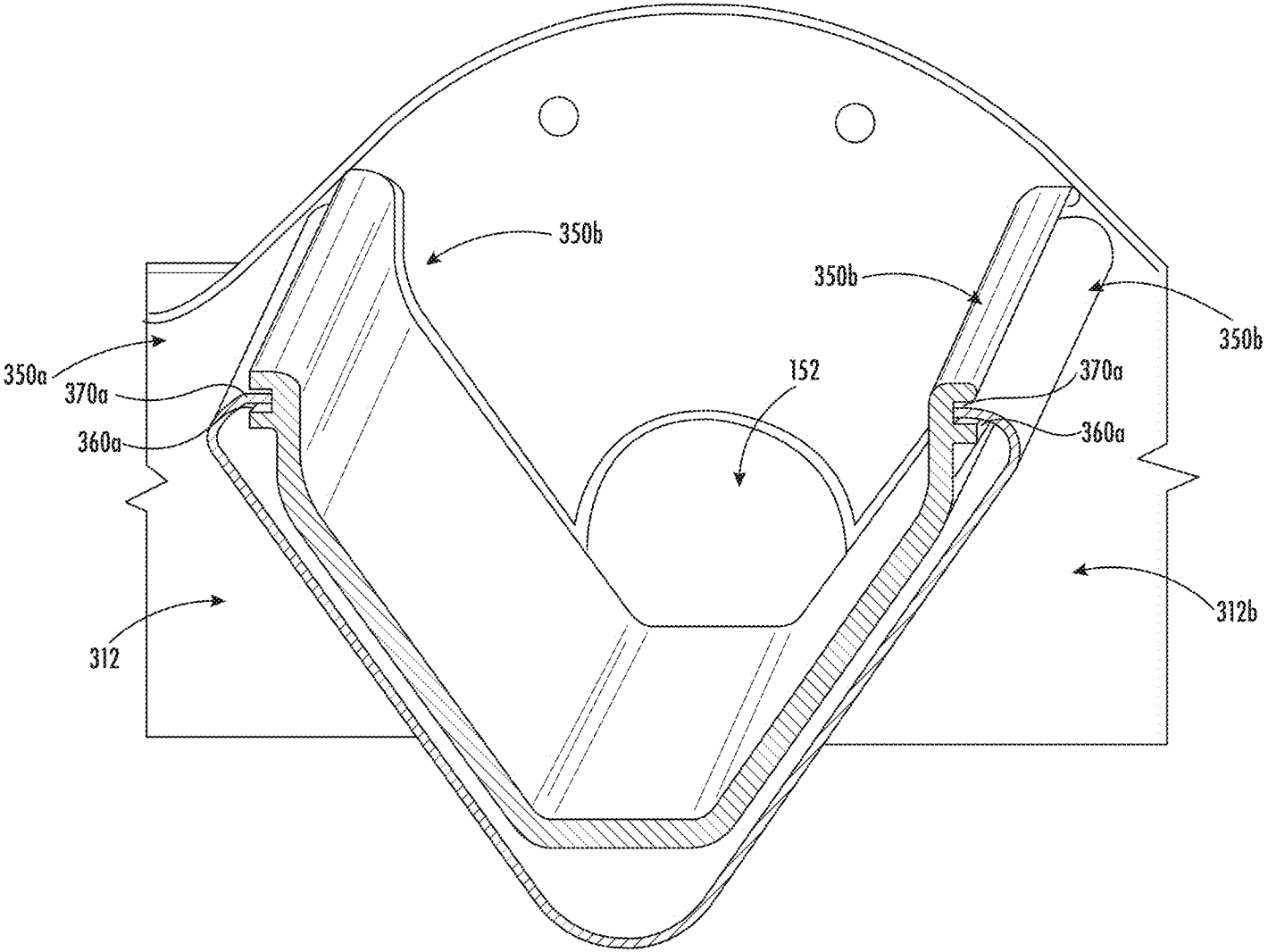

Turning to FIG. 7*d*, the heat shield 302 may be fastened to the first channel 152 at grooves 360*a*, 360*b* that span the top edges 350*a*, 350*b* of the first side surfaces 152*a*, 152*b*. Top edges 370*a*, 370*b* of the side walls 312 of the heat shield 302 may define return segments that are biased to engage the grooves 360*a*, 360*b*.

With the above disclosed embodiments, a heat shield is provided that may be made from one or more pieces of sheet metal (galvanized, aluminized, or stainless steel, or aluminum). The heat shield may be formed in such at a way that when attached to the receptor, it creates a cohesive, uniform aerodynamic profile, which may be optimized to minimize pressure drop across the coil and limit the impact of the receptor on air flow. When viewed from a bottom of the heat shield, the heat shield may cover part or all of the first channel of the receptor, blocking and reflecting radiative heat, preventing it from heating the receptor. The heat shield may be attached to the receptor in a manner that limits contact between the two parts (the heat shield and the receptor) and an air gap may be created between the surfaces on the parts, except for predetermined connecting points and/or at predetermined connecting grooves, minimizing conductive heat transfer. When viewed in a front section view, the receptor and heat shield may combine to form a profile that is conducive to flow attachment which in turn aids flow of air into the heat exchanger. The disclosed embodiments may improve airflow performance both around the receptor and into the heat exchanger through the use of flow optimization, as well as reduce temperature of the receptor material by further reducing radiation and enforcement of an air gap between the parts.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A system for receiving condensate from a v-coil micro-channel heat exchanger (v-coil), comprising:

a receptor that is T-shaped and comprises:

a first channel having a first length defined between first opposing ends, the first channel configured to receive the v-coil, the first channel having a first bottom surface;

a second channel disposed at an angle to the first channel and connecting with the first channel at a junction so that fluid flows downstream from the first channel into the second channel, the second channel having a second bottom surface that extends below the first bottom surface, the second channel extends to opposite ends and includes a drain port that is spaced apart from the junction and disposed at one or both of the opposite ends;

a heat shield connected to the first channel and extending below the first channel, and a v-coil fixedly supported by the receptor, wherein:

the first channel has a cross section with a top portion that is arcuate and converges toward a bottom portion of the v-coil;

the heat shield is V-shaped and includes sidewalls extending from a bottom apex;

a bottom surface of the heat shield, defined by the bottom apex, is level with the second bottom surface of the second channel, the bottom surface of the heat shield forms a rounded base; and the heat shield connects with the first channel at top edges of opposing side walls of the first channel.

2. The system of claim 1, wherein:

the heat shield has side walls that converge at the bottom surface of the heat shield so that an air gap is formed between the first channel and the heat shield.

3. The system of claim 1, wherein the heat shield connects with the first channel at or below a bottom portion of the first channel.

4. The system of claim 3, wherein the heat shield is fastened to the first channel at or below the bottom portion of the first channel.

5. The system of claim 4, wherein the heat shield is fastened against an upstream end of the first channel.

6. The system of claim 5, wherein the heat shield is fastened to the first channel with screws.

7. The system of claim 1, wherein a bottom portion of each of the opposing side walls of the first channel is oriented at a mutually converging angle and the side walls of the heat shield are oriented at the same converging angle so that the bottom portion of the side walls of the first channel and the side walls of the heat shield are parallel.

8. The system of claim 7, wherein a top portion of each of the opposing side walls of the first channel are mutually parallel and the heat shield and first channel are configured so that air gaps are provided between the top portion of each of the opposing side walls of the first channel and the heat shield.

9. The system of claim 8, wherein the side walls of the heat shield are offset from the bottom portion of each of the opposing side walls of the first channel, thereby providing air gaps between the heat shield and the bottom portion of each of the opposing side walls of the first channel.

10. The system of claim 9, wherein the heat shield has rounded top edges that extend toward one another to engage top edges of the opposing side walls of the first channel.

11. The system of claim 10, wherein contact between the heat shield and the first channel is only along the top edges of the opposing side walls of the first channel, thereby providing continuous air gaps between the heat shield and the first channel around the opposing side walls of the first channel and the bottom surface of the first channel.

12. The system of claim 11, wherein the heat shield connects with grooves formed in the top edges of the opposing side walls of the first channel.

13. The system of claim 12, wherein a span of the grooves in the top edges of the opposing side walls of the first channel is from an upstream end of the first channel to a downstream and of the first channel and the heat shield connects with the grooves along the span of the grooves.

14. The system of claim 13, wherein the heat shield is formed of a resilient material that biases the rounded top edges of the heat shield into the grooves of the first channel.

* * * * *